United States Patent [19]

Jones, Jr.

[11] Patent Number: 4,911,395

[45] Date of Patent: Mar. 27, 1990

[54] MOTOR BLOCK FOR OUTBOARD MOTOR WITH POWER TILT AND TRIM APPARATUS

[76] Inventor: John M. Jones, Jr., 422 Brewster Dr., Newark, Del. 19711

[21] Appl. No.: 327,426

[22] Filed: Mar. 23, 1989

Related U.S. Application Data

[63] Continuation of Ser. No. 159,014, Feb. 19, 1988, abandoned.

[51] Int. Cl.[4] ..... B63H 5/12

[52] U.S. Cl. ..... 248/351; 248/640

[58] Field of Search ..... 248/351, 640, 641, 642, 248/357, 359 E, 643; 440/53, 65, 900, 71

[56] References Cited

U.S. PATENT DOCUMENTS

| | | | |
|---|---|---|---|
| 1,704,303 | 3/1929 | Savage | 248/641 |
| 2,723,038 | 11/1955 | Peterson et al. | 248/351 |
| 2,934,303 | 4/1960 | Conrad | 248/351 |
| 2,977,084 | 3/1961 | Brown et al. | 248/351 |
| 3,693,576 | 9/1972 | Driscoll | 248/642 X |
| 4,125,236 | 11/1978 | Landwerlen | 248/640 |
| 4,501,561 | 2/1985 | Speelman | 248/351 X |
| 4,650,427 | 3/1987 | Huchinson | 248/351 X |
| 4,651,964 | 3/1987 | Kendrick | 248/351 |

*Primary Examiner*—Ramon S. Britts
*Assistant Examiner*—Karen J. Chotkowski
*Attorney, Agent, or Firm*—Sughrue, Mion, Zinn, Macpeak & Seas

[57] ABSTRACT

A molded plastic honeycomb block formed by a plurality of horizontal and vertical intersecting molded plastic walls define hollow rectangular cavities. Trim cylinder guide holes are provided within horizontal walls within a base portion to opposite sides thereof and sized to slidably receive trim cylinder rods of paired trim cylinders fixed to the motor mounting bracket on the transom of the boat and extending upwardly and outwardly of the transom at oblique, acute angles to the plane of the transom. The molded resilient plastic honeycomb block includes a narrow central projecting drive unit support portion terminating in a flat horizontal face which abuts the outboard motor propeller drive unit causing the outboard motor to be resiliently maintained in upwardly oblique overlying position with respect to the transom such that the block absorbs shocks otherwise transmitted during boat transfer on a trailer over rough ground being directed to the outboard motor and reducing torsional stress on the boat transom.

4 Claims, 2 Drawing Sheets

MOTOR BLOCK FOR OUTBOARD MOTOR WITH POWER TILT AND TRIM APPARATUS

This is a continuation of application Ser. No. 159,014 filed Feb. 19, 1988 now abandoned.

FIELD OF THE INVENTION

This invention relates to an outboard motor support block in a position between an outboard motor support bracket and the power unit for maintaining the outboard motor while mounted to a boat transom while supported on a trailer in upwardly oblique tilted position and more particularly, to a resilient molded plastic block which is self-oriented by integration with dual trim cylinder rods.

BACKGROUND OF THE INVENTION

Outboard motors are conventionally mounted for pivoting about a motor mounting bracket which bracket, in turn, is fixed to the center of the boat transom and aligned with the boat keel and which bracket is normally vertical or near vertical. This permits the outboard motor to be oriented in vertically upright position during operation of the boat. Outboard motors are relatively heavy and being supported on the transom of the hull, subject the transom and thus the boat hull to extreme stress while transported by a trailer.

Additionally, the outboard motor lower drive unit is designed to underlie the boat keel and to be positioned to the rear of the transom for propelling the boat. This places the outboard motor lower unit in a dangerous position during trailer transport. To alleviate this problem, both in lightweight outboard motors and in the heavier units, to which the present invention has application, conventionally the outboard motor is tilted from a near vertically upright position parallel to the plane of the hull transom, to a position where the motor is at an acute angle, with the motor mounting bracket element fixed to the transom, thus raising the outboard motor lower unit to a position generally above the keel.

U.S. Pat. No. 4,125,236, issued Nov. 14, 1978, U.S. Pat. No. 4,331,431, issued May 2, 1982, and U.S. Pat. No. 4,501,561, issued Feb. 26, 1985, are representative of devices which are integrated to the outboard motor and its mount to the transom of the boat, or detachably inserted between the mounting bracket and the outboard motor drive unit for maintaining the outboard motor drive unit tilted at a rearwardly and downwardly oblique position with respect to the transom and with the propeller unit raised relative to the surface of the ground upon which the boat trailer rides.

In tilting of the outboard motor drive unit forwardly, in order to raise the propeller assembly, due to the pivotable cam lever support of the outboard motor to the transom via the motor mounting bracket, the outboard motor subjects the boat transom to a constant torque or twisting force which over a period of time weakens or damages the transom, even where the motor is fairly well balanced on the transom. Further, vibrations due to haulage over rough roads causes the transom to receive undue twisting forces resulting in fatigue and possible failure of the transom.

It is therefore a primary object of the present invention to provide an outboard engine support member of unitary, molded plastic block form, having high resiliency integrally mounted to the trim cylinder rods of outboard motors equipped with power tilt and trim apparatus capable of supporting the weight of the outboard motor power unit, which absorbs shock to the outboard motor during transport over rough terrain which is lightweight, and of relatively small size.

DESCRIPTION OF THE PREFERRED EMBODIMENT

Figure 1:
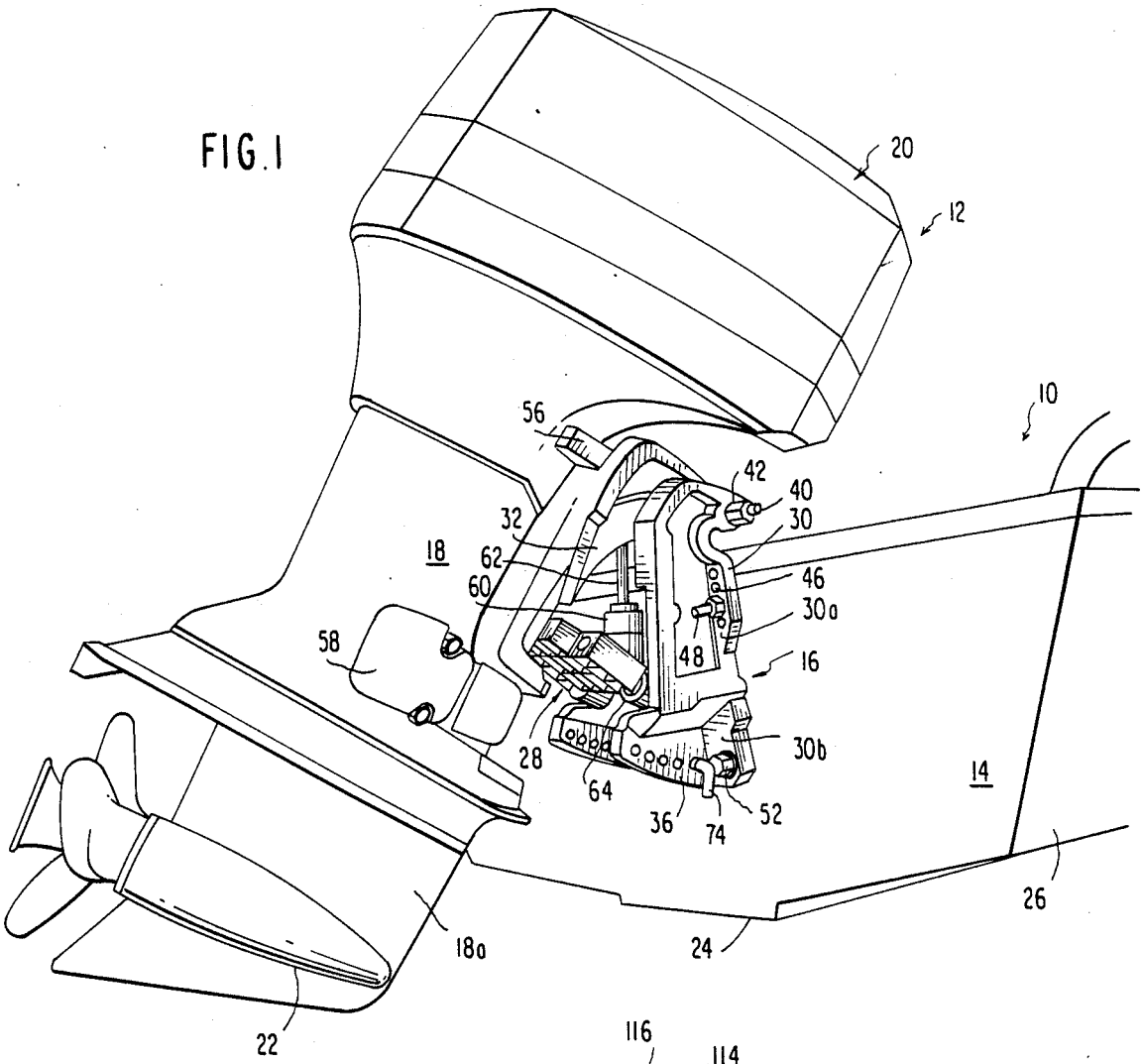
FIG. 1 is a perspective view of a trailer supported boat having an outboard motor mounted to the transom thereof, with the outboard motor drive unit tilted forwardly and maintained in the tilted position by a motor support block forming a preferred embodiment of the invention.

Referring to the drawings, FIG. 1 illustrates the rear portion of a outboard engine driven boat indicated generally at 10, in which an outboard motor indicated generally at 12 is supported to the rear of the boat transom 14 by means of a bracket indicated at 16. The boat 10 is supported on a trailer (not shown) for transport, and during transport, the outboard motor 10 drive unit 18 is pivoted forwardly with respect to the boat 10 upon which is mounted, such that the cover 20 extends forwardly of the transom 14 and the power unit 18 is downwardly and rearwardly inclined from the transom. This is in contrast to the normal position occupied by the power train which is essentially vertical and in line with the vertical transom 14 of the boat. Under these conditions, the outboard motor lower drive unit 18*a* has propeller assembly 22 in a raised position, such that the majority of the propeller assembly is above the level of the keel 24 of the hull 26, and of course raised above the surface of the ground upon which the trailer (not shown) rides.

Maintenance of the outboard motor in its forwardly inclined position, shown in FIG. 1, is accomplished by a motor support block indicated generally at 28, and interposed between a vertical plate 30 of bracket 16 and a central, pivoted arm or support member 32 fixedly mounted to the outboard motor drive unit 18, or integral therewith. The bracket 16 whether integrated to the outboard motor or attached thereto is conventional as is the outboard motor and forms no part of the present invention. Typically, the plate 30 of the bracket 16 includes planar portions as at 30*a*, 30*b* from which a pair of laterally spaced right angle flanges 36 extend, the flanges being provided with holes 38 at their upper ends through which a pivot pin or bolt 40 extends, the pivot pin or bolt 40 may include nuts as at 42 at opposite ends. The pivot pin 40 extends through a hole (not shown) within the upper end 32*a* of arm 32 for pivotably mounting the arm 32 for rotation about the horizontal axis of the pivot pin 40 as indicated by arrow 44, FIG. 1. Plate section 30*a* includes a vertical row of holes 46 through one of which, selectively passes a mounting bolt 48 upon which a nut 50 is threadedly mounted back by washer 52. The bolt 48 first passes through the transom 14 of the boat. A further bolt 52, backed by washer 54 passes through a hole carried by the lower plate portion 30*b*, that bolt extending through transom 14 and locking the bracket plate 30 to the transom 14 at that position. Similar mounting means are provided for the other flange 36 to the opposite side of arm 32. Arm 32 is integrated to the outboard motor drive train 18 by blocks 56 at the top and via blocks 58 adjacent the lower end 32*b* of arm 32. In order to tilt the outboard motor 12 relative to the transom 14 of the boat to which it is mounted, bracket 16 mounts via bolts 59, a power tilt and trim assembly 61 intermediate of flanges 36 (or otherwise). Assembly 61 includes a tilt cylinder 60 having a projecting tilt cylinder rod 62 which is pivotably coupled via pin 64 to the upper end 32*a* of arm 32 to the side of the pivot pin 40, such that by extension of retraction of tilt cylinder rod 62, the bracket arm 32 pivots that arm and the outboard motor drive unit 18 about the axis 40 as indicated by the double headed arrow 44.

Additionally, assembly 61 further includes between and adjacent flanges 36 of the motor mounting bracket 16 a pair of trim cylinders 64, which are fixedly mounted to the flange 36 or plate 30 of the bracket. Further, the trim cylinders 64 are oriented rearwardly oblique with respect to plate 30 and upwardly with respect to plate 30. Similarly to the tilt cylinder 60, each trim cylinder includes a trim cylinder rod 66 which projects axially outwardly of a trim cylinder casing 68, the cylinders 64 being parallel to each other, laterally spaced to opposite sides of the tilt cylinder 60, thus the trim cylinder rods 66 also being parallel to each other and obliquely inclined. The projected ends 66*a* of trim cylinder rods 66 abut opposite sides of flat plate portion 32*c* of arm 32 and control initial tilting of the drive unit 18, the balance of accurate raising of he outboard motor 18 being effected by hydraulic actuating of tilt cylinder 60.

Absent the interposition of the motor support block 28 of this invention, the trim cylinders 64 may be selectively actuated to project or retract the trim cylinder rods 66 as indicated by the double headed arrow 70, FIG. 1, the rods contacting a flat contact surface of plate portion 32*c* of the arm 32 to one side or the other of the outboard motor drive unit 18 and tilting the outboard motor to the extent of 15° relative to the boat.

The flanges 36, at their lower ends, are provided with a series of transverse holes 72 along an arc through which selectively projects one end 74*a* of a L-shaped locking pin 74 which end 74*a* extends through a hole 76 within the lower end 32*b* of arm 32, so as to lock the outboard motor drive unit 18 in an acute angularly pivoted position about pivot pin 40. This arrangement involving the locking arranged is conventional to such outboard motors 12.

Figure 2:
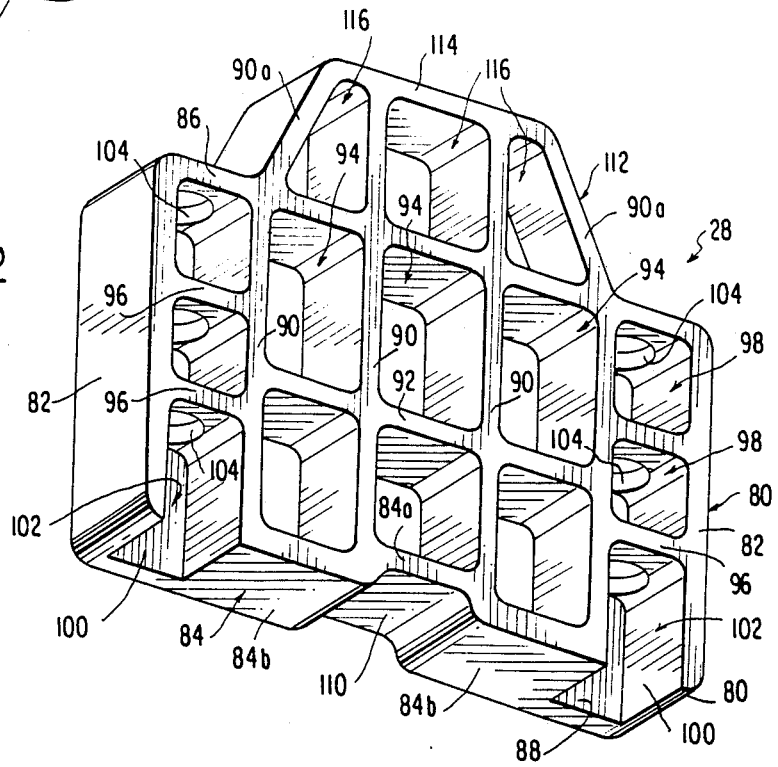
FIG. 2 is a perspective view of the motor support block of FIG. 1.
Figure 1A:
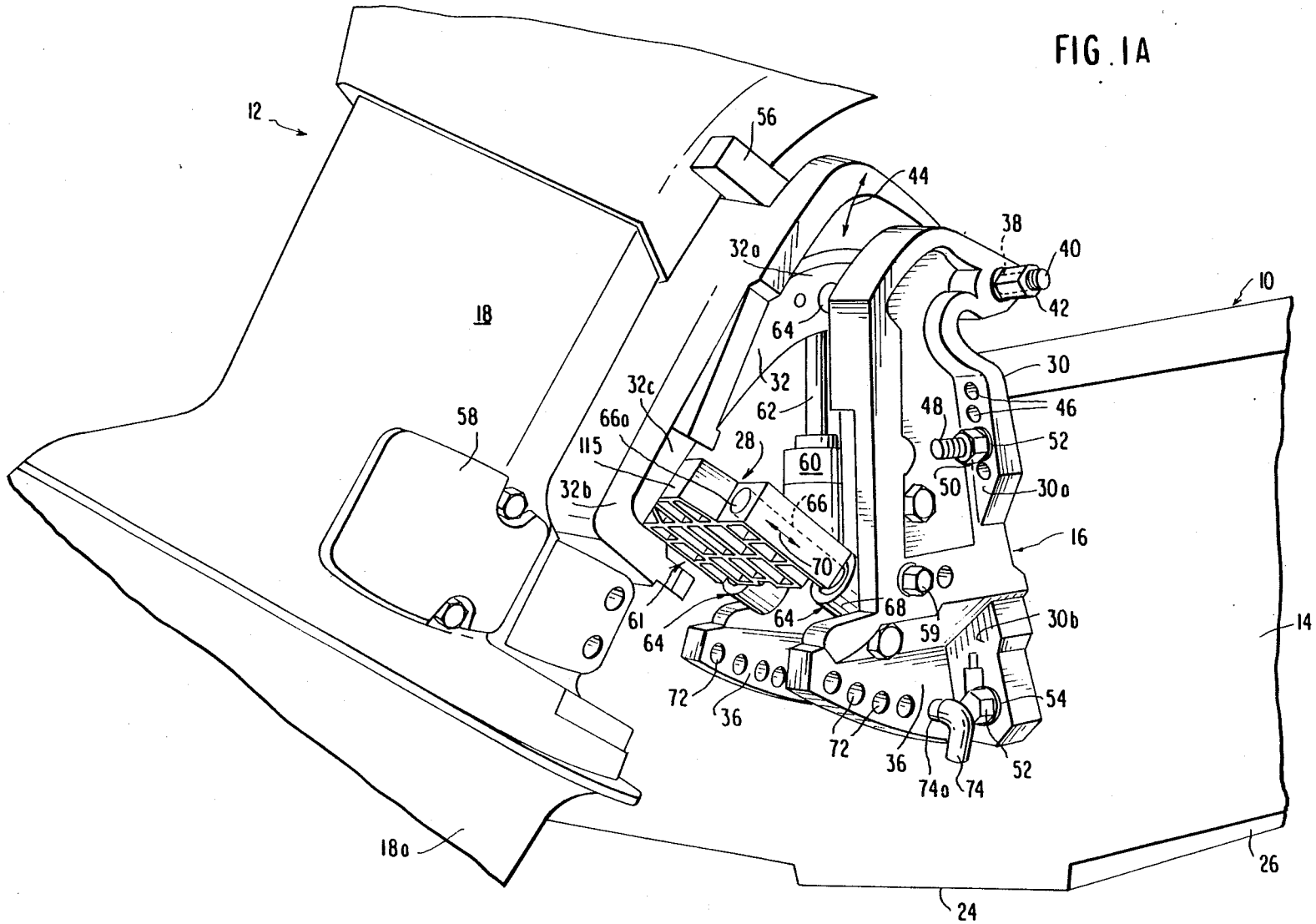
FIG. 1*a* is an enlarged perspective view of the motor support block as positioned in FIG. 1.

The motor support block 28 of the present invention is particularly suitable as a support device for outboard motors 12 equipped with power tilt and trim apparatus. By reference to FIG. 1 and particularly FIG. 2, in the preferred embodiment, block 28 is constructed of a thermoplastic material (such as high density polyethylene) and injection molded to support the weight of the outboard motor, to provide significant resiliency to absorb shock and to prevent abrupt shock being transferred to the outboard motor when mounted to a boat and transported by trailer over highways, country roads, trails or the like. The thermoplastic material of which the motor support block 28 is molded, may be fiberglass reinforced if desired. The motor support block 28 as seen in FIG. 2, is of modified inverted T-shaped configuration and of honeycomb form, including a rectangular base portion 80, having laterally opposed sidewalls 82, a bottom wall 84, a top wall 86 and a rear wall 88. The rear wall 88 extends only over a portion of the base 80 near the bottom wall 84 and adjacent opposite sidewalls 82 thereof. Preferably, the motor support block being of honeycomb form is defined by internal vertical walls 90 intersecting an integral horizontal wall 92 and defining generally rectangular openings or cavities 94 therebetween and with top and bottom wall 86, 84 and sidewalls 82. Additionally, the lateral side walls 82 are joined to intermediate vertical inside walls 90 by short length horizontal walls 96 forming on opposite sides, near rectangular cavities 98. Cavities 94, 98 extend fully from front to rear through the molded block 28. The bottom wall 84 is provided with openings or holes 100 between the lateral sidewalls 82 and interior walls 90 proximate thereto, further defining a window or entry 100 for vertical trim cylinder rod guide channels indicated generally at 102 to opposite sides of the motor support block base 80. Further, aligned circular holes are formed at 104 within top wall 86, and the short length horizontal interior walls 96 through cavities 98 of the base 80 and those at 102, 108 which open out to the bottom wall 84 of the motor support block 28. The bottom wall 84 of the base has a molded in offset 84*a* at its center, defining a molded in central recess 110 to accommodate the presence of the tilt cylinder 60 when operatively positioned between the base plate 30 of the motor support bracket and the power unit 18 of the outboard motor 12.

The base 80 of the motor support block 28 has integrally molded thereto and projecting upwardly from the top wall 86 of that base, a drive unit central support portion indicated generally at 112, which is integrally molded with the base portion 80 and which is narrower than the base portion 80. Portion 112 is likewise honeycombed. In that respect, the interior vertical walls 90 extend upwardly beyond the top wall 86 of the base, the outer two interior vertical walls 90 are bent obliquely as at 90*a* and are integrated to a central, horizontal motor support wall 114, forming three laterally spaced cavities 116 as active elements of the honeycomb structure. The molded honeycomb structure imparts significant resiliency to the molded plastic motor support block 28 to dampen vibration tending to reach the drive unit 18. The flat wall of the horizontal wall 114 of the drive unit support portion 112 forms a motor support surface which straddles the outboard motor drive unit 18, such that the weight of the outboard motor drive unit 18 is fully applied to the center of the honeycomb structure of the motor support block 28 resisted by the support block, and which is transferred through bottom support surfaces defined by portions 84*b* of the bottom wall 84 of the base portion 80 to opposite sides of the recess or cut out 110. The bottom wall surfaces 84*b*, to opposite sides of the cut out rest against the trim cylinders 64 and/or portions of the flanges 36 of the plate 30 of bracket 16.

The windows or cut outs 100 within tee base portion of the motor support block permit the front of the motor support block to be readily inserted in position obliquely as shown in FIG. 1, when the tilt cylinder 60 rotates the arm 32 clockwise, FIG. 1, to the extent where the lower portion 32*b* of the arm 32 swings away, sufficiently from the plate 30 and flanges 36, to permit the motor support block 28 to receive the rods 66, with the rods projected through the aligned holes 104 by passage through the trim cylinder rod guide channels 102 to opposite sides of the base portion 80 of the motor support block 28.

The holes 104 are of a diameter slightly in excess of the diameter of the trim cylinder rods to permit that mounting action. Once the trim cylinder rods enter the trim cylinder guide holes 104, the power tilt and trim controls (not shown) of the outboard motor 12 are further operated to cause the motor 12 to be lowered, i.e. rotated counterclockwise, FIG. 1, by retraction of the tilt cylinder rod 62 until contact is made between the arm portion 32*c* integrated to the drive unit 18 and the motor support surface 115 formed by horizontal wall 114 of the motor support portion 112 of the block 28. At this point, the trim switch is released leaving the trim cylinder rod 66 extended, positioned within holes 104 of the various horizontal walls 96 of the unitary motor support block 28, but always sufficiently below the motor support surface to permit some resilient compression of the honeycomb motor support block during transport of the boat and motor by the trailer supporting the same. The compression and expansion through the vertical center line of the block 28 results from the natural resiliency of the thermoplastic material honeycomb structure of the molded block 28 as per FIG. 2.

In the use of the motor support block 28 as set forth, there is the further benefit to the operator that the operator is away from the pinched points and the outboard protrusions, in that the power trim and tilt operating switch is normally in close proximity to the control console or throttle lever of the boat 10. Further, the small size and light weight of the motor block 28 makes it extremely easy to handle and store. Through the use of the device, there is adequate clearance provided between the lower drive unit 18*a* and propeller assembly 22 from irregularities experienced on any road surface that the transport trailer would normally travel.

Although a preferred embodiment of the motor support block has been described and illustrated, it will be understood that various changes may be made in the form, details, proportion and arrangement of parts, without departing from the invention as recited within the scope of the dependent claims hereto.

What is claimed is:

1. An outboard motor support block for inter-positioning generally between a propeller drive unit of an outboard motor and a motor mounting bracket plate secured to a boat transom wherein said motor is mounted for pivotable movement between an operative lower position proximate to said transom and in line therewith and an inoperative, raised, oblique position swung outwardly of the transom by means of a power tilt and trim assembly which includes a pair of trim cylinders having extendable rods, said motor support block comprising a resilient molded plastic structure having a first surface contacting said bracket plate and an opposite, second surface contacting said propeller drive unit, said block being formed of a compressable, highly resilient plastic material in the form of a honeycomb structure having a plurality of parallel cavities extending through said block in a direction of right angles to the line of forced application between said first and second surface for absorbing road shocks tending to pass from said bracket plate to said propeller drive unit and having two aperture means for passing through said block in a direction from said first surface towards said second surface, respectively adjacent opposite sides thereof and extending parallel to said opposite sides for receiving said trim cylinders and rods.

2. The motor support block as claimed in claim 1, wherein said block is of inverted T-shape including a base portion and a central leg portion extending upwardly therefrom, and wherein said second surface comprises a flat surface of said leg portion remote from said base portion, and said first surface comprises a parallel surface of the base portion remote from said leg portion.

3. The motor support block as claimed in claim 2, wherein said molded plastic honeycomb structure comprises a plurality of horizontal and vertical intersecting molded plastic walls defining said cavities, said cavities being of hollow rectangular form, wherein said apertures include openings in said base portion defining channels for said trim cylinders and aligned trim cylinder rod guide holes provided within horizontal walls within said base portion sized to slidably receive the trim cylinder rods of said trim cylinders, and wherein said molded resilient plastic honeycomb structure includes a relatively wide base portion and a narrow central projecting drive unit support portion terminating in a flat horizontal face forming said second surface and said base portion includes a flat horizontal bottom wall constituting said first surface contacting said bracket plate.

4. The motor support block as claimed in claim 3, further comprising a recess within said bottom wall of said motor support block base portion at the center thereof to accommodate a tilt cylinder mounted on said bracket plate between said trim cylinders when said motor support block is positioned on said bracket plate, with the projecting trim cylinders positioned within the trim cylinder channels and the rods projecting through the aligned trim cylinder rod guide holes within horizontal walls of said motor support block base portion.

* * * * *